United States Patent [19]

Levinson

[11] 4,027,132

[45] May 31, 1977

[54] MICROWAVE PIE BAKING

[76] Inventor: Melvin L. Levinson, 1 Meinzer St., Avenel, N.J. 07001

[22] Filed: Apr. 17, 1975

[21] Appl. No.: 569,018

[52] U.S. Cl. ..... 219/10.55 F; 426/243

[51] Int. Cl.² ..... H05B 9/06

[58] Field of Search ..... 219/10.55 E, 10.55 F; 426/107, 237, 241, 243, 242

[56] References Cited

UNITED STATES PATENTS

| | | | |
|---|---|---|---|
| 2,599,033 | 6/1952 | Wild | 219/10.55 E |
| 2,714,070 | 7/1955 | Welch | 219/10.55 E |
| 3,230,864 | 1/1966 | Krajewski | 219/10.55 E |
| 3,547,661 | 12/1970 | Stevenson | 219/10.55 E |
| 3,701,872 | 10/1972 | Levinson | 219/10.55 E |
| 3,731,037 | 5/1973 | Levinson | 219/10.55 E |
| 3,854,021 | 12/1974 | Moore et al. | 219/10.55 E |
| 3,854,023 | 12/1974 | Levinson | 219/10.55 E |

*Primary Examiner*—Bruce A. Reynolds

[57] ABSTRACT

Apparatus and methods for selectively defrosting and baking a frozen pizza pie by exposing the bottom crust of said pie to microwave radiation and using the waste heat expanded in said baking to heat the remainder of said pie while said remainder of said pie is impeded from receiving said microwave radiation by a vapor-permeable, microwave-reflective member and said bottom crust; and, then in the case of a frozen pie with a top as well as bottom crust, selectively heating the top crust of said pie during a second exposure to microwave radiation and using the waste heat expended baking said top crust during said second exposure to heat the balance of said pie while said balance is impeded from receiving said second exposure of microwave radiation by a vapor-permeable, microwave-reflective member and said top crust.

10 Claims, 3 Drawing Figures

MICROWAVE PIE BAKING

BACKGROUND OF THE INVENTION

1. Field of the Invention

This invention concerns the defrosting and baking of frozen convenience pies and concerns utensils designed for microwave baking.

2. Description of Prior Art

To achieve the versatility in microwave cooking that is expected in gas and electric cooking, a microwave oven must be supplied with as many different type and size cooking utensils as are available for gas and electric cooking. Microwave oven cooking utensils should be specially designed to capitalize on microwave energy's special characteristics and desirable cooking features. Numerous novel cooking containers have already been developed for microwave cooking, for example, my U.S. Pat. Nos. 3,539,751, 3,701,872, 3,731,037, 3,777,099, 3,985,990 and 3,985,991.

My U.S. Pat. No. 3,731,037 teaches how to employ a microwave-lossy, heat-insulated baking chamber to brown food. My U.S. Pat. No. 3,985,991, teaches using the latent heat of vaporization evolved from selectively heating one part of a food to heat a second part of said food. My U.S. Pat. Nos. 3,701,872 and 3,777,099 teach ways of shielding condensed water and rendered by-products from further heating in a microwave oven in competition with a heating article and so needlessly waste microwave power. Others, as in U.S. Pat. No. 2,714,070, have described apparatus which shields one area of an article from microwave exposure so as to provide selective heating of said article. My U.S. Pat. No. 3,985,990 teaches how to trap evolved hot vapor and how to condense said hot vapor and return its latent heat of vaporization to a heating system.

This invention concerns improvements in my previous inventions and is designed to improve the baking of pies with top and bottom crusts and pizza pies.

SUMMARY OF THE INVENTION

Methods of baking a frozen convenience pizza pie, fruit or meat pie in a microwave oven are described where a crust of said pie is selectively exposed to microwave radiation whereupon said crust heats and acts as a heating element to heat the balance of said pie.

It is an object of the invention to provide apparatus for use in microwave ovens which will facilitate the baking of the bottom crust of a pie.

It is a further object of this invention to describe methods of baking a pie with a bottom crust in a microwave oven without a requirement for an auxiliary active or passive, microwave-lossy heating element or an auxiliary gas or electric heating element.

DESCRIPTION OF THE PREFERRED EMBODIMENTS

Figure 1:
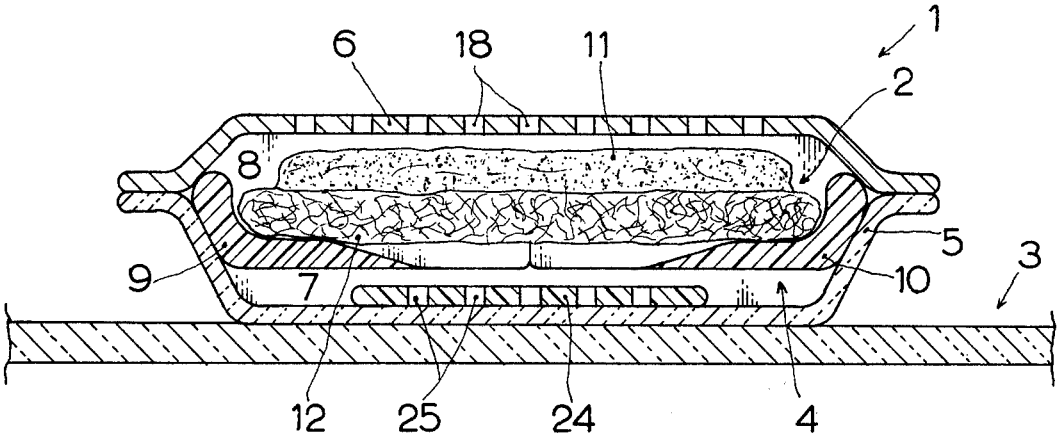
FIG. 1 is a utensil suitable for defrosting and baking a frozen pizza pie.

FIG. 1 illustrates a utensil 1 designed to defrost and bake pizza pie 2 while resting on microwave-permeable oven shelf 3 of a microwave oven (not shown). Utensil 1 includes microwave-permeable tray 4 resting in microwave-permeable container 5. A microwave-reflective, steam-permeable cover 6 covers container 5.

In operation, frozen pizza pie 2 is placed into container 5 on tray 4 and covered by snuggly fitting, non-touching, microwave-reflective cover 6 and exposed to microwave radiation on oven shelf 3 in a microwave oven (not shown). What happens is that, because of the reflective action of microwave-reflective cover 6, microwave radiation irradiates pizza pie 2's crust from its sides and bottom. The sides and bottom of pie 2 quickly heat and act as a lossy heating element for the topping 11 (e.g., the cheese and sauce) on pie 2's crust 12. During defrosting and baking, steam is trapped in chamber 7 and partial steam pressure builds up due to the resistance container 5 presents to the random free exit of said steam. Said built-up steam acts as a heat-insulating blanket, opposes microwave-oven-associated, spot-heating affects, and disperses water (e.g., evaporates and drives water outward — dries). Cover 6 is steam-permeable so steam can easily exit through perforations 18 in cover 6 and provide baking oven type results. Steam pressure can not build up in chamber 8. The drying, crusting and browning of pizza pie 2 is similar to that which is expected from gas and electric cooking. When well baked pie 2 is removed from a microwave oven, heat stored in hot crust 12 continues to boil topping 11 until crust 12 cools. As in gas and electric cooking, if a pie is cooked too long in a microwave oven undesirable burning or too much drying will occur. Arbitrarily permitting steam pressure to build up in chamber 8 as well as in chamber 7, by reducing the size and/or number of perforations 18, will provide pressure cooker type results (e.g., soft crust and more uniform heating) which some could desire.

An example of material suitable for the construction of utensil 1 follows:

1. Container 5 can be a Keyes Fibre Company's Chi-Net paper plate which is not wetted by cold water but only impedes steam transfer. In operation, the fibre paper contains a partial-pressure hot-vapor which hot-vapor heat-blankets and heat-insulates crust 12. This aides in uniform defrosting and baking of crust 12. Container 5 absorbs water run-off from cover 6 and absorbs water (e.g., vapor condensation) which would otherwise accumulate on shelf 3.
2. Cover 6 can be a perforated aluminum pie plate which shields pizza pie topping 11 from direct exposure to microwave radiation while permitting the free passage of steam. Metal screening, perforated aluminum foil and similar material are alternates. It is helpful to so place the holes in cover 6 as to permit a general view of topping 11 so that microwave baking can be visually monitored and terminated as desired. Cover 6, the aluminum pie plate, is chosen whose well is of such depth as to provide a snug fit without coming in contact with and so sticking to topping 12 as topping 11 bakes and boils.
3. Microwave-permeable tray 4 can be constructed of an anti-stick, high-temperature, microwave-permeable plastic as Teflon, constructed to support the periphery of pie 2 and can be hollowed out and/or open beneath the center of pie 2. The Teflon tray illustrated, in FIG. 1, has side walls, higher than topping 11, which impede initial run-off or boil-off of topping 11 over the sides of crust 12 before pie crust 12 defrosts and sags, at its center region, into the opening of tray 4 whereupon topping 11 puddles and boils towards the hollow which forms top center pie 2. This center sinking has utility because in microwave heating a pie is heated from its bottom in contrast to the simultaneous top and bottom heating of gas and electric heating. Teflon tray 4 can be constructed as mating parts 9 and 10 so, when a large pie is baked and cover 6 is removed, pie 2 is conveniently lowered, one side at a time, into paper container 5 for subsequent service. Alternately, since frozen pie 2 shrinks on defrosting and baking, tray 4's opening can be made large enough to support a frozen pie, but too large to support a heated pie (this requires quality control of pie size and material).

Teflon tray 4 need not have a recess beneath the center of pie 2 nor need the recess be open to container 5 nor is container 5 essential to baking a pie. Without an opening in Teflon tray 4, as microwave energy turns to heat within pie crust 12, steam is released and, as exposure to microwave energy continues, steam pressure builds up between the bottom of pie crust 12 and the top of Teflon tray 4 and drives water before it. Both the steam and the Teflon are excellent heat insulators. Pie 12 defrosts, cooks and crusts.

Without container 5 care must be excerised to limit water accumulation around pie 2 for after baking the water can flow back and wet crust 12. Without container 5, undesirable, unsightly accumulations of water, condensed steam, can appear on shelf 3 and thereabouts.

In FIG. 1, a plastic (e.g., Teflon, Nylon, polyester or other high temperature plastic) shield 24 can be placed within chamber 7 and there serve a multipurpose, for example, during heating it can catch overflow of filling 11 and subsequently receive pie 2 for service. Also, Telfon shield 24 can have perforations 25 for steam and water and can be used to keep heating sagging pie crust 12 from touching, and still uncooked, sticking to paper container 5. By employing shield 24, paper container 5 becomes semi-reusable. Anti-stick properties of Teflon tray 4 and shield 24 simplify clean up — even burned, crusted topping 11 comes off easily from Teflon.

The alternates, hereinbefore set forth, are useful to a cook who desires to cater to varying tastes, for instance, browness of crust, dryness of topping, etc. Also, for a given result, the cook is faced with a large variety of frozen convenience pies of various manufacture. It is anticipated that a cook will have a basic utensil and accessories and combine different combinations of elements to satisfy different requirements.

Figure 2:
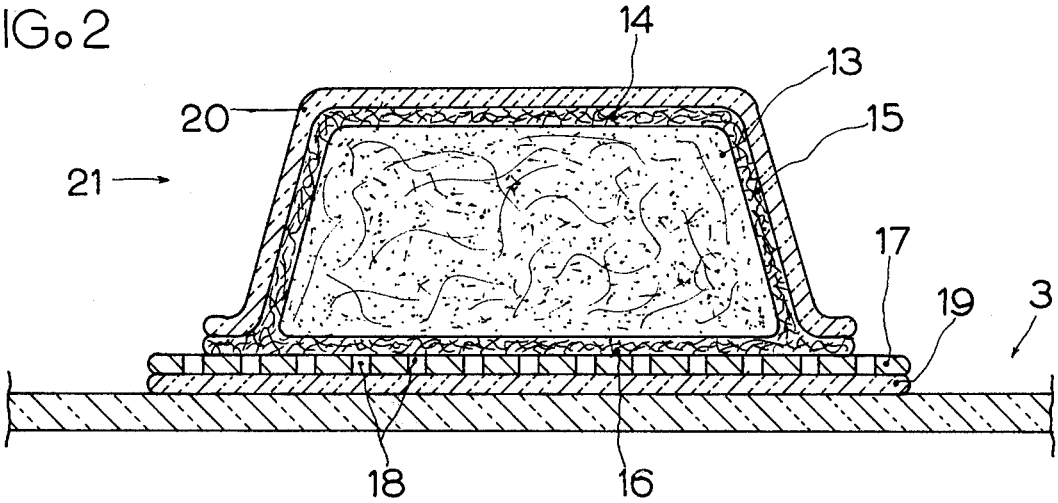
FIG. 2 is a utensil suitable for defrosting and baking the bottom crust of a pie with a complete bottom and top crust in a first step.

In FIG. 2, an inverted meat or fruit pie 21 with filling 13, bottom crust 14, side crust 15 and top crust 16 is illustrated. Top crust 16 rests inverted on top of metal plate 17. Metal plate 17 is perforated with holes 18 which permit water and vapor to pass therethrough while blocking radiation in a manner well known. Between metal plate 17 and microwave-permeable, oven shelf 3 is water-absorptive material 19. A hot-vapor-permeable, fibre-paper container 20 encloses bottom crust 14 and side crust 15.

In operation, a frozen meat or fruit pie is nested in fibre paper pie container 20. For example, a paper pie plate manufactured by Keyes Fibre Company under the trade name Chi-Net. Pie 21, in container 20 is inverted on perforated aluminum plate 17 on microwave oven shelf 3. The time required to defrost and bake pie 21 varies with the temperature of the freezer it was removed from, the desired crusting-browness and other such variables. For a given freezer temperature, microwave oven power level, pie weight, desired external baked appearance, etc., baking time is determined empirically. Once the baking time per ounce is determined, it holds quite well for different fruit and meat fillings. Baking time per ounce falls off as weight increases. Inverted, pie 21 is exposed to microwave radiation for that fraction (circa ⅓ to ½) of the time estimated for baking, which is long enough for filling 13 to defrost and heat but not hot enough to rupture through its crust. During said inverted baking, metal plate 17 shields top crust 16 from direct exposure to microwave radiation while microwave radiation, passing freely through pie plate 20, bakes bottom crust 14 and side crust 15. A pie's filling is denser than its crust and so it takes more energy to defrost and raise the temperature of pie filling 13 than crust 16. Microwave energy's change to heat starts at the outer surface of a pie crust and decays into the filling. In effect, a pie's crust partially shields its filling from microwave exposure. Hence, bottom crust 14 and side crust 15 are able to heat to a hotter temperature (e.g., crusting temperature) than pie filling 13. Fibre pie plate 20 functions to hold the defrosting, heating pie in proper pie shape and initially confine hot vapor which evolves during the baking of bottom crust 14 and side crust 15. Hot vapor disperses between said crust and said plate across said crusts external surfaces. Moreover, paper pie plate 20, a heat-insulating material, heat-insulates heating bottom crust 14 and side crust 15 from the cool ambient conditions normally present in a microwave oven chamber. Without pie plate 20, bottom crust 14 and side crust 15 would (evaporating water directly from their exposed surfaces) be cooling in opposition to microwave heating, but, with pie plate 20, it is the external surface of plate 20, off of which water evaporates, which cools. Cool oven ambients and water evaporating off its surface cools paper plate 20 below its browning temperature. Advantageously, paper pie plate 20 absorbs shortening used in crust forming and results in a flakier baked crust.

Before the crust of pie 21 ruptures and filling 13 extrudes, the first exposure of pie 21 to microwave radiation is terminated. Next pie 21 in container 20 is righted into an upright position, FIG. 3, and together with container 20 nested into an aluminum pie plate 22 perforated with small holes 23 which pass water and water vapor but not microwave radiation. Whereupon, the partially baked pie, as illustrated in FIG. 3, is exposed again to microwave radiation until raw top pie crust 16 bakes.

Figure 3:
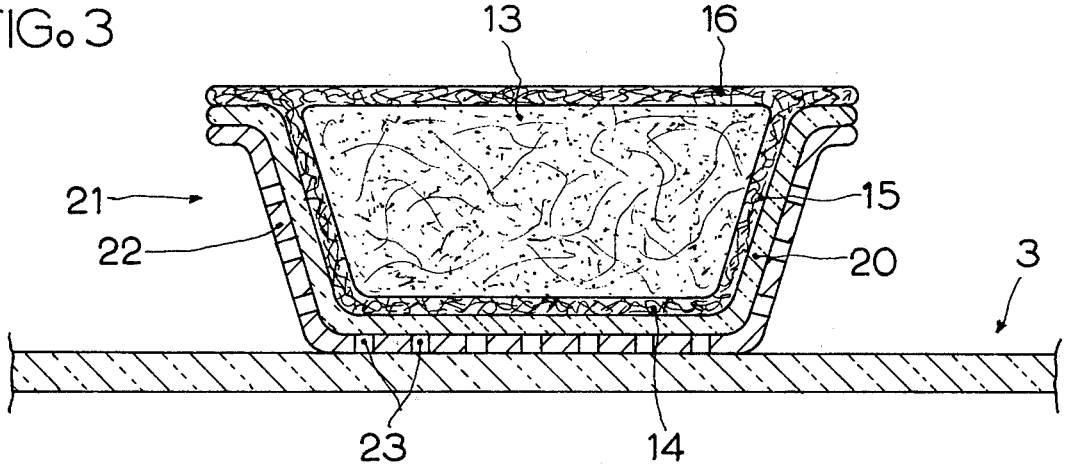
FIG. 3 is a utensil suitable for defrosting and baking the top crust of the pie of FIG. 2 in a second step.

Faster baking and/or more or less browning of either pizza pie 2, in the apparatus of FIG. 1, or pie 21, FIGS. 2 and 3, can be accomplished in the apparatus and by the methods set forth in my U.S. Pat. Nos. 3,985,990 and 3,985,991. Namely, in U.S. Pat. No. 3,985,991, utilizing the apparatus and methods of this invention within a microwave-permeable, liquid-absorptive container; or, in U.S. Pat. No. 3,985,990, within a special apparatus to condense water vapor and reuse the heat of vaporization; or, in U.S. Pat. No. 3,731,037, within a special preheated lossy baking oven. In every case, caution must be excercised to see that sufficient clearance is provided for microwave radiation to reach the crusts to be browned.

In FIG. 1, if container 5's well is deep enough to permit microwave radiation to impinge directly on crust 12, either the metal floor of a microwave oven (not shown) or the perforated metal surface and condensation chamber of my U.S. Pat. No. 3,985,990, can be substituted for microwave-permeable, oven shelf 3.

In FIG. 2, perforated metal plate 17 and water absorptive material 19 can be respectively the perforated metal surface and the condensation chamber of my U.S. Pat. No. 3,985,990.

Microwaves speed in baking makes practical new convenience. For example, large frozen, convenience, pizza pies can be defrosted and preheated by the methods and in the apparatus described and then, in scaled down apparatus, individual servings finished sequentially, at a rate equal that by which said servings are consumed; or, at a rate equal to that by which small pies are consumed, a series of small pies can be baked sequentially. Capitalizing on microwave oven cooking speed, sequential baking will insure that each serving or small pie is served freshly baked and hot.

Although this invention has been described with a certain degree of particularity, it is understood that the present disclosure has been made only by way of example and that numerous changes in the details of construction and in the combination and arrangement of parts and in the methods described may be resorted to without departing from the spirit and scope of the invention.

I claim:

1. Apparatus for baking a pizza pie by exposing said pie to microwave radiation which comprises:

a microwave-reflective, vapor-permeable cover to block the entrance of said microwave radiation from entering through the top of the topping of said pie, a first tray, for supporting at least the peripheral portion of said pie's crust, said second tray being of a microwave-permeable material and having at least one opening beneath the central portion of said pie's crust, and means supporting said second tray with respect to said first tray, with said second tray spaced from the bottom of said first tray to form a microwave-permeable steam-confining chamber therebetween when said pizza pie is in place and properly oriented.

2. Apparatus for baking, according to claim 1, which includes:

where said second tray consists of, at least, two independent parts.

3. Apparatus for baking, according to claim 1, which includes:

where said second tray is made of an anti-stick, baking-temperature-resistant material.

4. Apparatus for baking, according to claim 1, which includes:

where said first tray is paper.

5. Apparatus for baking, according to claim 1, which includes:

where said opening is smaller than said pie, unbaked, but large enough to permit said pie, baked, which, on baking, shrinks away from said peripheral support, to fall therethrough.

6. A method of baking a pizza pie in a microwave oven the steps which include:

partially shielding, by microwave-reflective vapor-permeable means, the topping of said pie from direct exposure to microwave radiation, exposing said crust of said pie to microwave radiation, and confining, by microwave-permeable means, steam released by said pie's crust, during said exposure to microwave radiation, beneath said crust to form a partial-pressure, heat-insulating steam-blanket across the bottom of said crust until said pie crust is baked.

7. A method of baking a pizza pie in a microwave oven, without the requirement for prior art gas, electric and microwave-lossy auxiliary heating elements, the steps which include:

placing said pie within an enclosure which shields, by means of microwave-reflective, vapor-permeable material, the topping of said pie from microwave exposure while permitting unshielded microwave exposure of, at least, the inner center of the crust of said pie, supporting said pie's crust with microwave-permeable material designed to support the peripheral portion of said pie's crust higher than the central portion of said pie's crust so that on subsequent exposure to microwave radiation, said topping is unable to overflow over the sides of said crust, and exposing said pie within said enclosure to microwave radiation until said crust bakes and browns and said topping is heated to a serving temperature.

8. A method of baking a pizza pie in a microwave oven, without the requirement for prior art gas, electric and microwave-lossy auxiliary heating elements, the steps which include:

placing said pie within an enclosure which shields, by means of microwave-reflective, vapor-permeable material, the topping on said pie from microwave exposure while permitting unshielded exposure of, at least, the inner center of the crust of said pie, walling said pie's crust with an anti-stick baking-temperature-useful, microwave-permeable material so that on subsequent exposure to microwave radiation, said topping is unable to overflow the sides of said crust, and exposing said pie within said enclosure to microwave radiation until said crust bakes and said topping is heated to a serving temperature.

9. A method of baking a pizza pie in a microwave oven the steps which include:

shielding the topping of said pie with a microwave-reflective, vapor-permeable member, placing said pie in said microwave oven where, at least, said pie's inner crust, during the following step of exposing said pie to microwave radiation, will be irradiated by said microwave radiation and bake, and exposing said pie to microwave radiation until (1) said crust bakes and (2) said topping heats both from microwave radiation passing through said crust and from heat energy evolved in said baking of said pie's crust.

10. A method of baking a pie with a top, bottom and side crust, by exposing said pie to microwave radiation within a microwave oven, while said pie is nested in a microwave-permeable, vapor-permeable pie plate, the steps of which include:

inverting said pie while in said pie plate, disposing said inverted pie and plate within said microwave oven so that said pie's top crust is shielded from direct exposure to microwave radiation by a microwave-reflective member, exposing said inverted pie to microwave radiation until said bottom and side crusts bake, and subsequently inverting said pie and plate into their upright position, disposing, in proximity to a microwave-reflective, vapor-permeable body, said pie and plate, within said microwave oven, so that said bottom and side crusts are shielded from direct exposure to microwave energy, and exposing said top crust to microwave radiation until said top crust bakes.

* * * * *

UNITED STATES PATENT AND TRADEMARK OFFICE

CERTIFICATE OF CORRECTION

PATENT NO. : 4,027,132

DATED : May 31, 1977

INVENTOR(S) : Melvin L. Levinson

It is certified that error appears in the above-identified patent and that said Letters Patent are hereby corrected as shown below:

CLAIM 1 (correction underlined):

Apparatus for baking a pizza pie by exposing said pie to microwave radiation which comprises:

a microwave-reflective, vapor-permeable cover to block the enterance of said microwave radiation from entering through the top of the topping of said pie, a first tray.

a second tray for supporting at least the peripheral portion of said pie's crust, said second tray being of a microwave-permeable material and having at least one opening beneath the central portion of said pie's crust, and means supporting said second tray with respect to said first tray, with said second tray spaced from the bottom of said first tray to form a microwave-permeable steam-confining chamber therebetween when said pizza pie is in place and properly oriented.

Signed and Sealed this

Sixteenth Day of May 1978

[SEAL]

Attest:

RUTH C. MASON
Attesting Officer

LUTRELLE F. PARKER
Acting Commissioner of Patents and Trademarks